US010974504B2

(12) United States Patent
Yamazaki et al.

(10) Patent No.: US 10,974,504 B2
(45) Date of Patent: Apr. 13, 2021

(54) LIQUID EJECTION HEAD AND CONTROL METHOD OF LIQUID EJECTION HEAD

(71) Applicant: CANON KABUSHIKI KAISHA, Tokyo (JP)

(72) Inventors: Takuro Yamazaki, Inagi (JP); Yoshiyuki Nakagawa, Kawasaki (JP); Toru Nakakubo, Kawasaki (JP); Kazuhiro Yamada, Yokohama (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/720,940

(22) Filed: Dec. 19, 2019

(65) Prior Publication Data

US 2020/0198335 A1 Jun. 25, 2020

(30) Foreign Application Priority Data

Dec. 25, 2018 (JP) ..... JP2018-241290

(51) Int. Cl.
*B41J 2/18* (2006.01)
*B41J 2/14* (2006.01)
*B41J 2/045* (2006.01)

(52) U.S. Cl.
CPC ..... *B41J 2/04573* (2013.01); *B41J 2/0458* (2013.01); *B41J 2/14145* (2013.01); *B41J 2/18* (2013.01)

(58) Field of Classification Search
CPC .. B41J 2/04573; B41J 2/0458; B41J 2/14145; B41J 2/04588; B41J 2/1404; B41J 2202/12
See application file for complete search history.

(56) References Cited

U.S. PATENT DOCUMENTS

| | | | | |
|---|---|---|---|---|
| 9,090,084 | B2 * | 7/2015 | Govyadinov | F04B 19/24 |
| 9,403,372 | B2 * | 8/2016 | Taff | B41J 29/393 |
| 10,639,888 | B2 * | 5/2020 | Morisue | B41J 2/14201 |
| 10,717,273 | B2 * | 7/2020 | Nakagawa | B41J 2/1404 |
| 2019/0023016 | A1 | 1/2019 | Nakagawa et al. | |

FOREIGN PATENT DOCUMENTS

| | | | |
|---|---|---|---|
| JP | 2017-177437 | A | 10/2017 |
| WO | 2011/146069 | A1 | 11/2011 |
| WO | 2013/130039 | A1 | 9/2013 |

* cited by examiner

*Primary Examiner* — Huan H Tran
(74) *Attorney, Agent, or Firm* — Venable LLP

(57) ABSTRACT

A liquid ejection head can stably eject a liquid from an ejection port by mitigating thickening of the liquid by evaporation from the ejection port. The liquid ejection head has a support substrate; a liquid chamber arranged on the support substrate and provided with an energy generating element for generating energy necessary for ejection of a liquid and an ejection port from which the liquid is ejected; and a circulation flow path of the liquid that passes through the liquid chamber. The liquid ejection head further has a first circulating element that forms a first circulatory flow in the circulation flow path; and a second circulating element that forms a second circulatory flow inside the liquid chamber and a driving frequency of the first circulating element is lower than a driving frequency of the second circulating element.

18 Claims, 11 Drawing Sheets

LIQUID EJECTION HEAD AND CONTROL METHOD OF LIQUID EJECTION HEAD

BACKGROUND OF THE INVENTION

Field of the Invention

The present invention relates to a liquid ejection head and a control method of a liquid ejection head.

Description of the Related Art

In an ink jet printer, a liquid ejection head (also referred to as print head) for ejecting a liquid, such as ink, is mounted. In the liquid ejection head, as a result of a volatile component in a liquid evaporating from an ejection port from which a liquid is ejected, there is a case where the liquid in the vicinity of the ejection port thickens. By thickening of the liquid, there is a case where the ejection velocity of liquid droplets to be ejected changes or the landing accuracy is affected. In particular, in a case where the printer rest time after performing ejection is long, thickening of the liquid advances and the solid component of the liquid solidifies in the vicinity of the ejection port. As a result of this, by the solid component, the liquid resistance of the liquid increases and there is a case where defective ejection occurs.

As one of the measures against the thickening phenomenon of the liquid such as this, a method is known in which a liquid that has not thickened yet (so-called fresh liquid) is caused to flow through a liquid chamber, and in addition thereto, the ejection port. As a method of causing a liquid to flow, there is known a method of causing a liquid within the head to circulate by a differential pressure method. International Publication No. WO 2011/146069 has disclosed a method in which a pull-in flow of a liquid from the side of the flow path whose flow resistance is low is used at the time of refill after heating and bubble generation by an auxiliary resistor arranged at an asymmetrical position of the within-flow path flow resistance. International Publication No. WO 2013/130039 has disclosed a method that uses a micro pump causing an AC electroosmotic flow (ACEOF) to occur.

SUMMARY OF THE INVENTION

However, by the method described in International Publication No. WO 2011/146069, the velocity of the pull-in flow depends on the flow path resistance at the time of refill, and therefore, in a case where a liquid having a high viscosity, such as an ink whose pigment concentration is high, is used or in a case where a flow path whose width or height is small is adopted, there is a possibility that sufficient flow velocity is not obtained. Because of that, it is not possible to cause a liquid sufficiently fresh for sending out the liquid concentrated within the ejection port to flow into the liquid chamber, and therefore, the concentrated liquid is likely to stagnate within the ejection port.

According to the method described in International Publication No. WO 2013/130039, it is possible to cause a fresh ink to flow into the liquid chamber. However, an element that plays a role of a pump does not exist in the flow path on the downstream side of the ejection port, and therefore, the effect of causing a liquid within the ejection port to flow out is faint. Because of this, the concentrated liquid is likely to stagnate within the ejection port. As described above, these patent documents have such a problem that the liquid within the ejection port is likely to thicken due to evaporation of the liquid from the ejection port.

Consequently, in view of the above-described problem, an object of the present invention is to mitigate thickening of a liquid due to evaporation from the ejection port and make it possible to stably eject a liquid from the ejection port.

One embodiment of the present invention is a liquid ejection head including: a support substrate; a liquid chamber arranged on the support substrate and provided with an energy generating element for generating energy necessary for ejection of a liquid and an ejection port from which the liquid is ejected; and a circulation flow path of the liquid that passes through the liquid chamber, and the liquid ejection head further includes: a first circulating element that forms a first circulatory flow in the circulation flow path; and a second circulating element that forms a second circulatory flow inside the liquid chamber and a driving frequency of the first circulating element is lower than a driving frequency of the second circulating element.

Further features of the present invention will become apparent from the following description of exemplary embodiments with reference to the attached drawings.

DESCRIPTION OF THE EMBODIMENTS

In the following, with reference to the drawings, a liquid ejection head according to embodiments of the present invention is explained. In each of the following embodiments, an ink jet print head that ejects ink and an ink jet printing apparatus are taken to be the target, but the present invention is not limited to this. It is possible to apply the present invention to a printer, a copy machine, a facsimile machine having a communication system, a device, such as a word processor having a printer unit, and further, an industrial printing apparatus that compositely combines various processing apparatuses. For example, it is possible to use the present invention for the purpose of biochip manufacturing, electronic circuit printing, and the like.

The embodiments described in the following are preferred specific examples of the present invention and a variety of technically favorable restrictions are imposed thereon. However, as long as the thought of the present invention is observed, the present invention is not limited to the embodiments described below.

First Embodiment

<About Structure of Liquid Ejection Head>

Figure 1A:
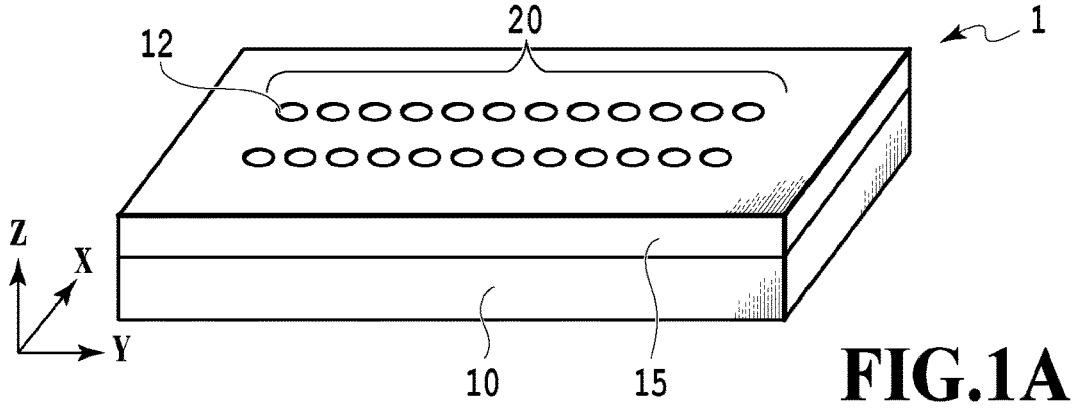
FIG. 1A to FIG. 1D are each a schematic diagram of a liquid ejection head according to a first embodiment.
Figure 1B:
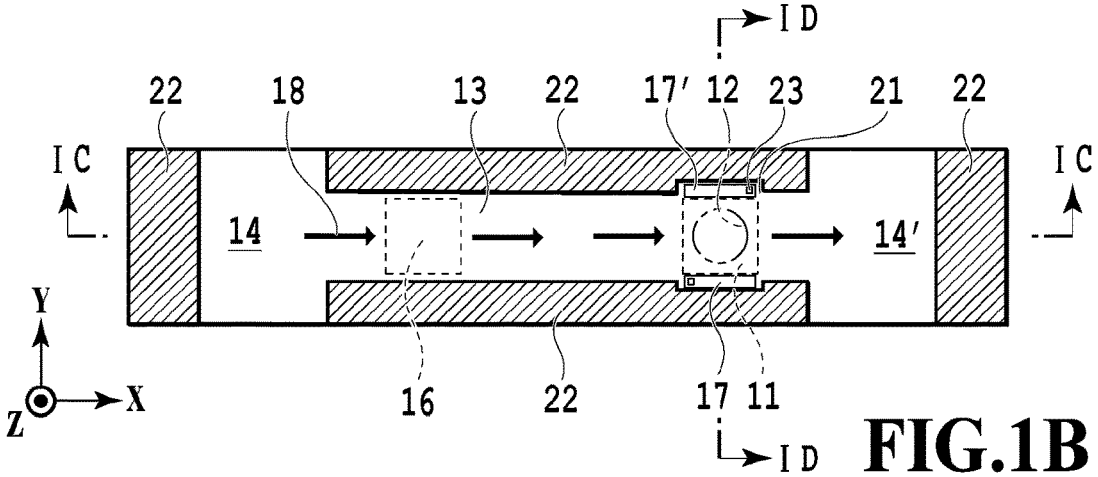
Figure 1C:
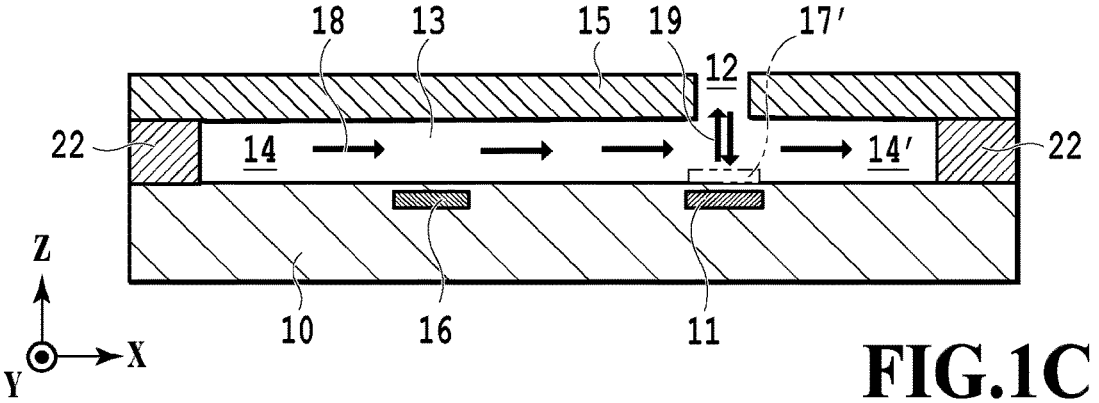
Figure 1D:
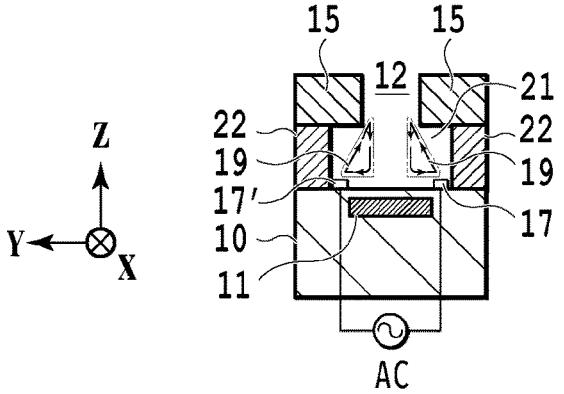

FIG. 1A is a perspective diagram of a printing element substrate 1, which is a part of a liquid ejection head according to a first embodiment of the present invention. FIG. 1B is a schematic diagram showing a liquid movement direction on a plane obtained by truncating the printing element substrate 1 in a plane parallel to a bonding face of a support substrate 10 and an ejection port forming member 15 shown in FIG. 1A. FIG. 1C is a schematic diagram showing a liquid movement direction on a section along an IC-IC line in FIG. 1B. FIG. 1D is a schematic diagram showing a liquid movement direction on a section along an ID-ID line in FIG. 1B.

The printing element substrate 1 has the support substrate 10 and the ejection port forming member 15. The ejection port forming member 15 is bonded to the support substrate 10. The support substrate 10 is provided with an energy generating element 11 for generating energy necessary for ejection of ink. The energy generating element 11 is provided for each liquid chamber (also referred to as pressure chamber) 21. In the ejection port forming member 15, a plurality of ejection ports 12 is arranged. The plurality of the ejection ports 12 is arrayed in one row and forms an ejection port row 20. The printing element substrate 1 of the present embodiment has two rows of the ejection port row 20, but the number of ejection port rows 20 is not limited to this and an arbitrary one value may be adopted.

As shown in FIG. 1A, the direction in which the ejection ports are arrayed is taken to be a Y-axis direction, the direction in which ink is ejected from the ejection port is taken to be a Z-axis direction, and the direction perpendicular to the Y-axis direction and the Z-axis direction is taken to be an X-axis direction. This coordinate axes are also used in common in subsequent explanation.

As shown in FIG. 1B and FIG. 1C, by a space between the ejection port forming member 15 and the support substrate 10 being partitioned by a flow path forming member 22, a liquid flow path 13 for each ejection port 12 is formed. The liquid flow path 13 is a part of the flow path (referred to as circulation flow path) through which ink circulates and in the liquid flow path 13, a plurality of the liquid chambers 21 comprising the energy generating element 11 and the ejection port 12 corresponding to each liquid flow path 13 is formed on the support substrate 10.

In the space between the ejection port forming member 15 and the support substrate 10, the liquid chamber 21 is formed by the space being partitioned by the flow path forming member 22. The liquid chamber 21 is a space partitioned by the support substrate 10, the ejection port forming member 15, and the flow path forming member 22, and provided on the way of the liquid flow path 13, and has a dimension equal to or more than that of the liquid flow path 13 in the Y-axis direction. In each of the plurality of the liquid chambers 21 on the printing element substrate 1, the energy generating element 11 and second circulating elements 17 and 17', to be described later, are arranged.

The ejection port 12 faces the energy generating element 11 in the direction perpendicular to the bonding face of the support substrate 10 and the ejection port forming member 15. The liquid flow path 13 is connected, at the end portion on the upstream side, to a first liquid supply flow path 14 formed between the ejection port forming member 15 and the support substrate 10 and at the end portion on the downstream side, connected to a second liquid supply flow path 14' formed between the ejection port forming member 15 and the support substrate 10. Consequently, the first liquid supply flow path 14, the liquid flow path 13, the liquid chamber 21, and the second liquid supply flow path 14' form an independent flow path for each ejection port 12. The first liquid supply flow path 14 and the second liquid supply flow path 14' extend in parallel to the ejection port row 20 with the ejection port row 20 being sandwiched in between and connected to an ink supply tank, not shown schematically.

Ink is supplied from the first liquid supply flow path 14 to the liquid chamber 21 through the liquid flow path 13. The ink supplied to the liquid chamber 21 is heated by the energy generating element 11 and ejected from the ejection port 12 by a force of air bubbles generated by heating. The ink that is not ejected from the ejection port 12 is guided from the liquid chamber 21 to the second liquid supply flow path 14' through the liquid flow path 13. The ink guided to the second liquid supply flow path 14' is ejected from another ejection port, or the ink not ejected from any ejection port is finally returned to an ink supply tank, not shown schematically.

In the liquid flow path 13, a first circulating element 16 is provided on the support substrate and at the same time, within the liquid chamber 21, the second circulating elements 17 and 17' are provided. The first circulating element 16 is configured by a heating element and the like. The first circulating element 16 may have the same configuration as that of the energy generating element 11 or may have a different configuration. The dimension of a first electrode and that of a second electrode are the same, both included in an electrode pair of the second circulating elements 17 and 17'. A pair of these electrodes is formed at a position whose height is different from that of the energy generating element 11 on the support substrate so that the electrodes are symmetrical with respect to the energy generating element 11 as a reference (specifically, in the form in which the electrodes sandwich the energy generating element 11). Each electrode of the electrode pair of the second circulating elements 17 and 17' is connected to one end of an alternating-current power source AC by a wire, not shown schematically, via a contact hole 23. Here, it is assumed that the electrode forming the second circulating element 17 is connected to the + terminal of the alternating-current power source AC and on the other hand, the electrode forming the second circulating element 17' is connected to the − terminal of the alternating-current power source AC. However, the electrode forming the second circulating element 17 may be connected to the − terminal of the alternating-current power source AC and the electrode forming the second circulating element 17' may be connected to the + terminal of the alternating-current power source AC.

<About Liquid Flow Path Circulatory Flow 18 that Occurs by First Circulating Element 16>

Figure 2A:
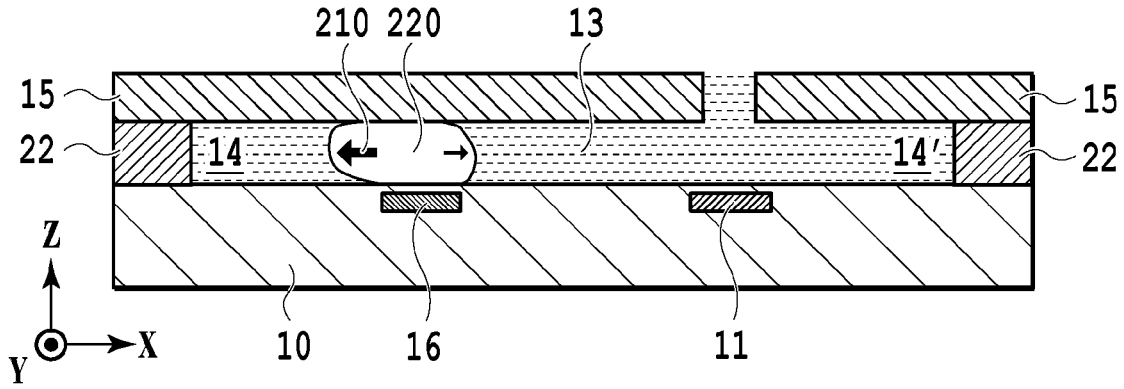
FIG. 2A to FIG. 2C are each a schematic diagram for explaining a mechanism of occurrence of a liquid flow path circulatory flow.
Figure 2B:
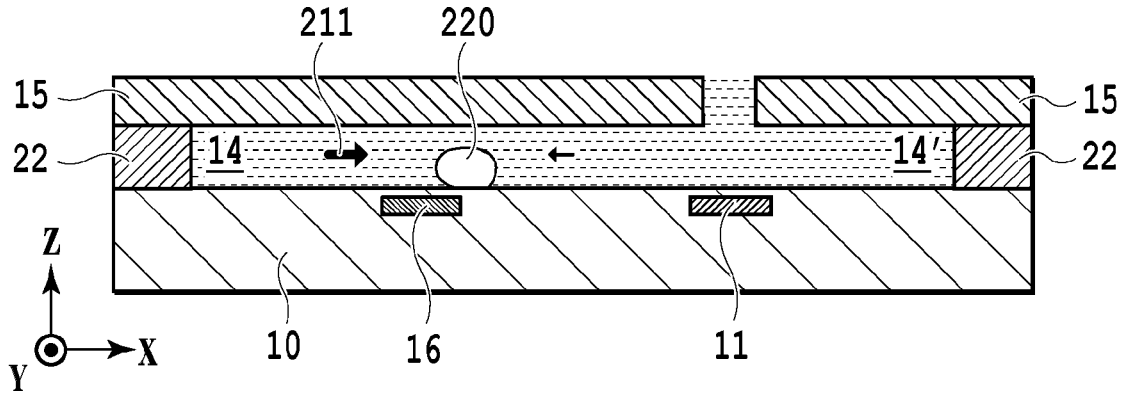
Figure 2C:
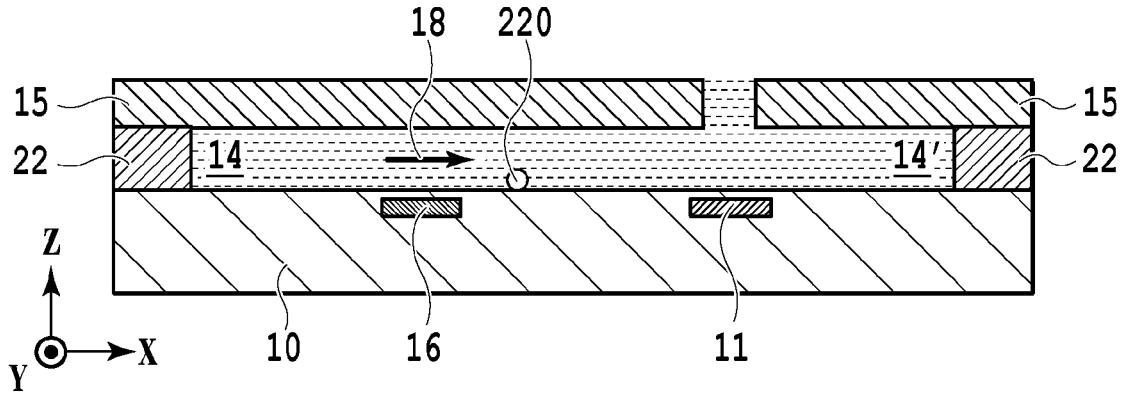

To the heating element of the first circulating element 16, a heating pulse current is applied. As a result of that, as shown in FIG. 1B and FIG. 1C, a liquid flow path circulatory flow 18 that advances from one end of the liquid flow path 13 toward the other end occurs. The liquid flow path circulatory flow 18 is a flow that collects the liquid not ejected from the ejection port 12 from the liquid chamber 21 as well as guiding the liquid to be ejected to the liquid chamber 21. The reason the liquid flow path circulatory flow 18 occurs is explained by using FIG. 2A to FIG. 2C. FIG. 2A to FIG. 2C are each a schematic diagram for explaining the mechanism of occurrence of the liquid flow path circulatory flow 18 at the section position shown in FIG. 1C.

FIG. 2A is a diagram showing the way ink is heated by the heating element of the first circulating element 16 and an air bubble 220 generated by film boiling grows. The first circulating element 16 is arranged at a position whose distances to the positions of both end portions of the liquid flow path 13 are different, a so-called within-flow path asymmetrical position. One end portion of the liquid flow path 13 is connected to the first liquid supply flow path 14 and the other end portion of the liquid flow path 13 is connected to the second liquid supply flow path 14'. In a case where the flow resistance in the first liquid supply flow path 14 is sufficiently high compared to the liquid flow path 13, the flow resistance in the liquid flow path 13 in the range from the first circulating element 16 to the first liquid supply flow path 14 mainly depends on the distance between the first circulating element 16 and the first liquid supply flow path 14. Similarly, in a case where the flow resistance in the second liquid supply flow path 14' is sufficiently high compared to the liquid flow path 13, the flow resistance in the liquid flow path 13 in the range from the first circulating element 16 to the second liquid supply flow path 14' mainly depends on the distance between the first circulating element 16 and the second liquid supply flow path 14'.

In a case in FIG. 2A, the flow resistance from the first circulating element 16 to the first liquid supply flow path 14 on the left side in FIG. 2A is lower than the flow resistance from the first circulating element 16 to the second liquid supply flow path 14' on the right side in FIG. 2A. Consequently, the air bubble 220 due to film boiling is formed so as to inflate toward the left side whose flow resistance is low. A liquid movement 210 by bubble generation indicates that the air bubble 220 grows more on the left side in FIG. 2A whose flow resistance is low compared to the right side in FIG. 2A.

FIG. 2B shows a shrinkage process of the air bubble 220. In the shrinkage process of the air bubble, as shown by an arrow 211, more ink is refilled from the liquid flow path 13 on the left side in FIG. 2B whose flow resistance is low than from the liquid flow path 13 on the right side in FIG. 2B whose flow resistance is high. As a result of this, as shown in FIG. 2C, the bubble disappearance position of the air bubble 220 shifts from the position on the first circulating element 16 toward the right side in FIG. 2C whose flow resistance is high and from a macroscopic viewpoint, a flow that advances in one direction from one end of the liquid flow path 13 toward the other end, that is, the liquid flow path circulatory flow 18 occurs. This liquid flow path circulatory flow 18 attenuates as the air bubble 220 disappears and stops after a predetermined time elapses.

In order to cause the liquid flow path circulatory flow 18 to occur steadily for a certain time, bubble generation and refill by the first circulating element 16 described previously are repeated. By the liquid flow path circulatory flow 18 that occurs by the first circulating element 16 provided in the liquid flow path 13, fresh ink flows from the first liquid supply flow path 14 into the liquid chamber 21 through the liquid flow path 13. In a case where the energy generating element 11 is operating, part of the ink having flowed into the liquid chamber 21 is ejected from the ejection port 12. The ink that is not ejected from the ejection port 12 flows out to the second liquid supply flow path 14' through the liquid flow path 13.

Also in a case where the energy generating element 11 is not operating, the liquid flow path circulatory flow 18 occurs by applying a heating pulse current to the heating element of the first circulating element 16, and therefore, the ink flows through the liquid flow path 13 from the side of the first liquid supply flow path 14 toward the side of the second liquid supply flow path 14'. Consequently, even in a case where the ink concentrates within the liquid chamber 21, it is possible to suppress stagnation of the concentrated ink within the liquid chamber 21.

The driving cycle of the first circulating element 16 configured by the heating element and the like is not limited in particular as long as it is possible to attain discharge of the concentrated ink within the liquid chamber 21, but preferably, it is possible for the first circulating element 16 to drive at about 100 Hz to 10 kHz. However, in a case where the drive frequency representing the number of driving times of the first circulating element 16 per unit time is high, there is a possibility that the rise of the ink temperature within the liquid flow path 13 due to heating becomes problematic. Consequently, it is preferable to set an upper limit value of the drive frequency in accordance with the allowable amount of temperature rise.

<About Flow Velocity Distribution and Liquid Chamber Circulatory Flow 19 that Occur by Second Circulating Elements 17 and 17'>

To the electrodes configuring the second circulating elements 17 and 17', an alternating-current voltage is applied. As a result of that, as indicated by an arrow in FIG. 1D, a flow velocity distribution occurs within the liquid chamber 21, in which the flow velocity is high on the surface of the support substrate 10 and the flow velocity gradually approaches zero as the ejection port forming member 15 becomes nearer. The reason this flow velocity distribution occurs is explained by using FIG. 3A to FIG. 3D.

Figure 3A:
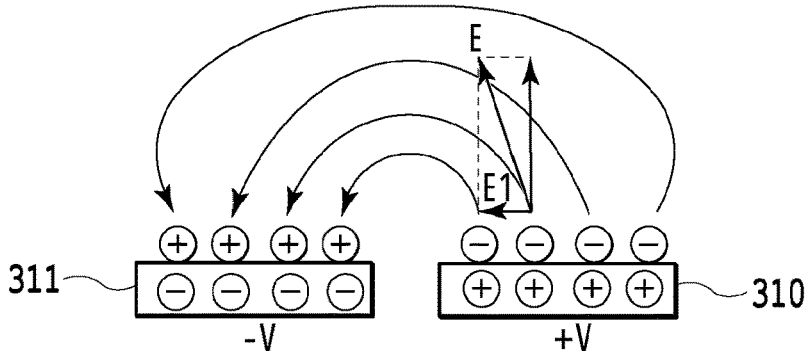
FIG. 3A to FIG. 3D are each a schematic diagram for explaining a mechanism of occurrence of a flow velocity distribution that occurs by an electroosmotic flow.

The two electrodes configuring the second circulating elements 17 and 17' are taken to be a first electrode 310 and a second electrode 311, respectively. The first electrode 310 and the second electrode 311 have the same dimension. As shown in FIG. 3A, an electric double layer occurs in the first electrode 310 and the second electrode 311, respectively. To explain in detail, a positive voltage (+V) is applied to the first electrode 310 and the ink in contact with the first electrode 310 is charged negatively, and thus, an electric double layer configured by a lower layer charged positively and an upper layer charged negatively is formed. Similarly, a negative voltage (−V) is applied to the second electrode 311 and the ink in contact with the second electrode 311 is charged positively, and thus, an electric double layer configured by a lower layer charged negatively and an upper layer charged positively is formed.

Figure 3B:
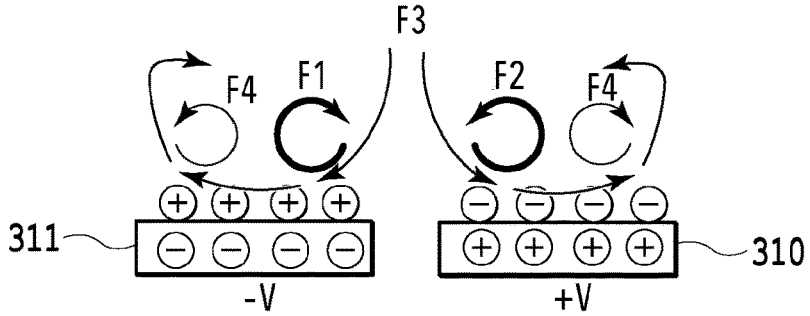

By the ink being charged as described previously, in the ink, an electric field E in the shape of a semicircle is formed, which extends from the first electrode 310 toward the second electrode 311. This electric field is symmetrical with respect to the intermediate line between the first electrode 310 and the second electrode 311. On the surface of the first electrode 310, an electric field component E1 parallel to the surface of the first electrode 310 is generated and similarly, on the surface of the second electrode 311, the electric field component E1 parallel to the surface of the second electrode 311 is generated. The electric field component E1 exerts the Coulomb force on charges induced on the first electrode 310 and charges induced on the second electrode 311. The electric field component E1 faces in the leftward direction in FIG. 3A at a position in the vicinity of a gap (referred to as inter-electrode gap) between the first electrode 310 and the second electrode 311. The positive charge receives a force whose direction is the same as that of the electric field, and therefore, as shown in FIG. 3B, a rotation vortex F1 occurs, which causes the ink in the vicinity of the second electrode 311 to flow in the leftward direction in FIG. 3B. On the contrary, the negative charge receives a force whose direction is opposite to that of the electric field, and therefore, a rotation vortex F2 occurs, which causes the ink in the vicinity of the first electrode 310 to flow in the rightward direction in FIG. 3B. Due to the rotation vortex F1 and the rotation vortex F2, the ink flows in the direction away from the inter-electrode gap, and therefore, an ink flow F3 that replenishes ink occurs in the inter-electrode gap.

Further, at each electrode, at the end portion apart from the inter-electrode gap, the direction of the electric field is opposite to that at the end portion near to the inter-electrode gap, and therefore, a rotation vortex F4 occurs, whose rotation direction is opposite to that of the rotation vortex that occurs at the end portion near to the inter-electrode gap. However, compared to the end portion near to the inter-electrode gap, the electric field component E1 at the end portion apart from the inter-electrode gap is weak, and therefore, the Coulomb force exerted on the ink is small. As a result of this, a stir flow that advances from the inter-electrode gap toward the first electrode 310 and advances in the direction away from the inter-electrode gap on the first electrode 310 and a stir flow that advances from the inter-electrode gap toward the second electrode 311 and advances in the direction away from the inter-electrode gap on the second electrode 311 are formed. As shown in FIG. 3B, these two stir flows are bilaterally symmetrical.

Figure 3C:
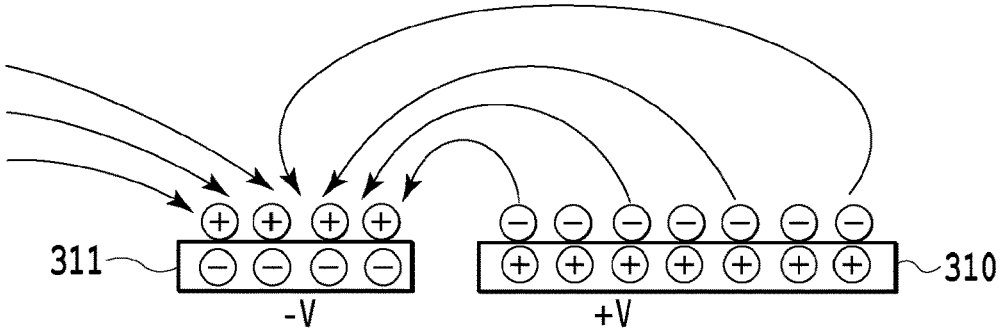
Figure 3D:
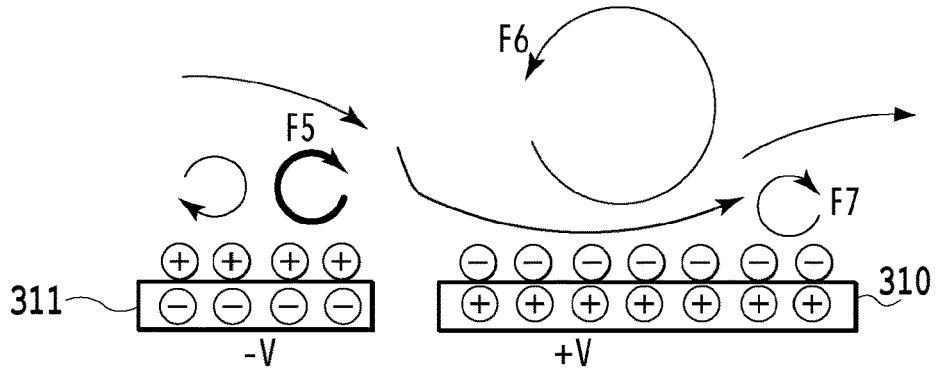

In FIG. 3A and FIG. 3B, the case is explained where the first electrode 310 and the second electrode 311 have the same dimension. In contrast to this, in a case where the first electrode 310 and the second electrode 311 have different dimensions (specifically, different widths), as shown in FIG. 3C and FIG. 3D, the electric field distribution is different between the first electrode 310 and the second electrode 311. By the electric field distribution such as this, at the position in the vicinity of the second electrode 311 and at which the potential is high, a rotation vortex F5 whose flow velocity is high and whose diameter is small is formed. On the other hand, in the vicinity of the first electrode 310, at the position at which the potential is low, a rotation vortex F7 whose flow velocity is low and whose diameter is small is formed and at the position at which the potential is high, a rotation vortex F6 whose flow velocity is low and whose diameter is large is formed. As a result of these rotation vortexes being formed, an ink flow in which ink is pulled into the inter-electrode gap from the second electrode 311 and flows from the inter-electrode gap toward the first electrode 310 occurs, that is, from a macroscopic viewpoint, an ink flow in which ink flows from the second electrode 311 toward the first electrode 310 occurs.

The above contents also apply similarly to a case where a positive voltage (+V) is applied to the second electrode 311 and a negative voltage (−V) is applied to the first electrode 310. That is, even in a case where the polarity of the voltage to be applied is reversed, both the sign of the charge and the orientation of the electric filed are reversed, and therefore, the orientation of the flow that occurs does not change. Consequently, a steady flow occurs as a result, which advances from the second electrode 311 whose width dimension of the electrode is small toward the first electrode 310 whose width dimension of the electrode is large. This flow has an alternating-current frequency of 100 Hz to 100 kHz and the flow velocity thereof is high, and called an AC electroosmotic flow (ACEOF). Depending on the value of voltage to be added, water electrolysis occurs, and therefore, it is desirable to set the value of voltage to be applied in a range in which water electrolysis does not occur.

By the steady electroosmotic flow such as this, a flow velocity distribution occurs (see FIG. 1D), which forms two vortexes at positions approximately symmetrical with respect to the energy generating element 11 or the ejection port 12 as a reference. The flow component that passes the vicinity of the ejection port 12 is formed, and therefore, it is possible to cause the concentrated ink in the vicinity of the ejection port 12 to flow and send the ink into the liquid chamber. Consequently, it is easy to suppress concentration of ink in the vicinity of the ejection port 12. The second circulating elements 17 and 17' are connected to the alternating-current power source AC, and therefore, the occurrence of a bubble due to water electrolysis is suppressed compared to the direct-current power source DC and it is possible to increase the drive voltage.

In the present embodiment, by using the first circulating element 16 and the second circulating element 17 in combination, a configuration is implemented in which the concentrated ink within the ejection port 12 is pushed out efficiently and the ink can be replaced with fresh ink.

Only by the liquid flow path circulatory flow 18 by the first circulating element 16, the effect of pushing and causing the concentrated ink within the ejection port 12 to flow is obtained. However, in a case where the flow velocity is not sufficient, the effect is limited, and therefore, there is a possibility that it is not possible to secure sufficient ejection stability. Further, only by the liquid chamber circulatory flow 19 by the second circulating elements 17 and 17', the effect of sending out the concentrated ink within the ejection port 12 into the liquid chamber 21 and diluting the concentrated ink within the liquid chamber is obtained. However, in a case where ejection by the energy generating element 11 is not performed for a predetermined time or more, the concentration of the ink within the liquid chamber 21 advances, and therefore, there is a possibility that it is no longer possible to eject ink from the ejection port 12. As described above, in a case where one of the first circulating element 16 and the second circulating elements 17 and 17' is used, there is a possibility that it is not possible to secure sufficient ejection stability.

In order to solve this problem, in the present embodiment, by combining the first circulating element 16 and the second circulating elements 17 and 17', the concentrated ink within the ejection port 12 is sent into the liquid chamber 21 by a stir flow and at the same time, the sent concentrated ink is replaced with fresh ink by the liquid flow path circulatory flow 18. Due to this, even in a case where the velocity of the liquid flow path circulatory flow 18 is lower than the conventional velocity, it is made possible to secure ejection stability and the drive condition of the first circulating element 16 is mitigated. Consequently, it is possible to extend the range of alternatives relating to inks with a variety of viscosities.

<About Driving Method of First Circulating Element 16 and Second Circulating Elements 17 and 17'>

Figure 4A:
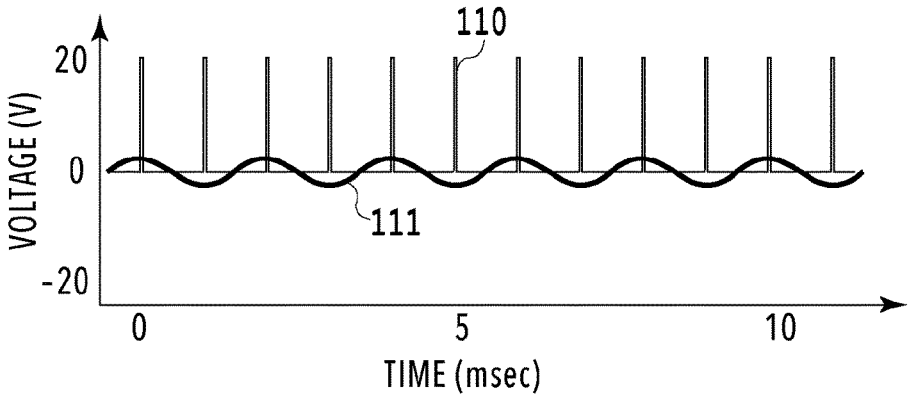
FIG. 4A to FIG. 4C are each a diagram showing each drive signal of a first circulating element and a second circulating element.
Figure 5A:
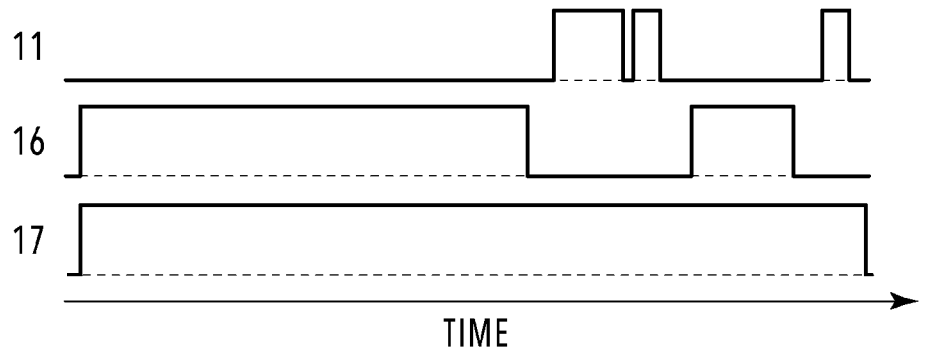
FIG. 5A to FIG. 5C are each a diagram showing each drive timing of an energy generating element, the first circulating element, and the second circulating element.

Next, by using FIG. 4A and FIG. 5A, a driving method of the first circulating element 16 and the second circulating elements 17 and 17' is explained. FIG. 4A is an image diagram of a drive signal of each of the first circulating element 16 and the second circulating elements 17 and 17' in a case where both are driving. FIG. 5A is an image diagram of the driving timing of the energy generating element 11, the first circulating element 16, and the second circulating elements 17 and 17'.

In the present embodiment, the first circulating element 16 is a heating element. Symbol 110 in FIG. 4A indicates a pulse wave as the drive signal of the first circulating element 16. As shown in FIG. 4A, in order to drive the first circulating element 16, a voltage of 24 V is applied at 1 kHz.

Further, the second circulating elements 17 and 17' are AC electroosmotic flow generating elements. Symbol 111 in FIG. 4A indicates a sinusoidal wave, which is the drive signal of the second circulating elements 17 and 17'. As shown in FIG. 4A, in order to drive the second circulating elements 17 and 17', a sinusoidal wave alternating-current voltage that varies in a range of ±2.5 V is applied at 500 Hz. The drive signal of the first circulating element 16 and the second circulating elements 17 and 17' according to the present embodiment is not limited to each signal waveform. It is possible to selectively set the voltage, the frequency, and the waveform of the drive signal in a range in which desired flow velocity is obtained for the liquid flow path circulatory flow 18 and the liquid chamber circulatory flow 19 described previously.

As shown in FIG. 5A, the driving timing of the first circulating element 16 is interlocked with the driving timing of the energy generating element 11. Specifically, the first circulating element 16 drives by avoiding the period during which the energy generating element 11 is driving and a predetermined period before and after the drive thereof so that the first circulating element 16 is not affected by bubble generation by the energy generating element 11, which is a heating element, and the pressure variation by ink refill, and thus, the liquid flow path circulatory flow 18 is formed. On the other hand, the driving timing of the second circulating elements 17 and 17' is not interlocked with the driving timing of the energy generating element 11. The liquid chamber circulatory flow 19 is formed by the second circulating elements 17 and 17' driving at all times irrespective of the presence/absence of ejection.

In the present embodiment, by using in combination a gate array for applying the signal shown in FIG. 4A and a gate array for applying the signal at the timing shown in FIG. 5A, drive control for each liquid flow path 13 described previously is implemented. However, it may also be possible to implement this drive control by software not by control by hardware. For example, it may also be possible to make a layout in which the ink jet printing apparatus has a CPU, a ROM, and a RAM and the drive of the first circulating element and the second circulating element is controlled by a program stored in the ROM being loaded onto the RAM and being executed by the CPU.

About Effect of the Present Embodiment

By the above configuration, an ink flow that advances from one end toward the other end within the liquid flow path 13 occurs by the first circulating element 16 and a fresh ink flow that crosses the liquid chamber 21 occurs. Because of this, it is possible to suppress the ink having concentrated within the liquid chamber 21 from stagnating. Further, a flow component of the ink that advances toward the ejection port 12 occurs within the liquid chamber 21 by the second circulating elements 17 and 17'. Because of this, it is possible to efficiently suppress ink concentration within the ejection port 12. In the present embodiment, by the configuration in which the above two are combined, it is made possible to efficiently discharge the concentrated ink to the outside of the liquid chamber 21 by pushing out the thickened ink within the ejection port 12 into the liquid chamber 21 and sending fresh ink into the liquid chamber 21. Consequently, it is possible to eject comparatively fresh ink whose effect of reducing ink thickening within the ejection port 12 is strong and whose degree of thickening is low. As a result, it is made possible to reduce the color unevenness of an image.

Second Embodiment

In the following, a printing element substrate of a liquid ejection head according to a second embodiment is explained. In the following explanation, differences from the first embodiment are explained mainly. The contents of the portion whose specific explanation is omitted are the same as those of the first embodiment.

Figure 6A:
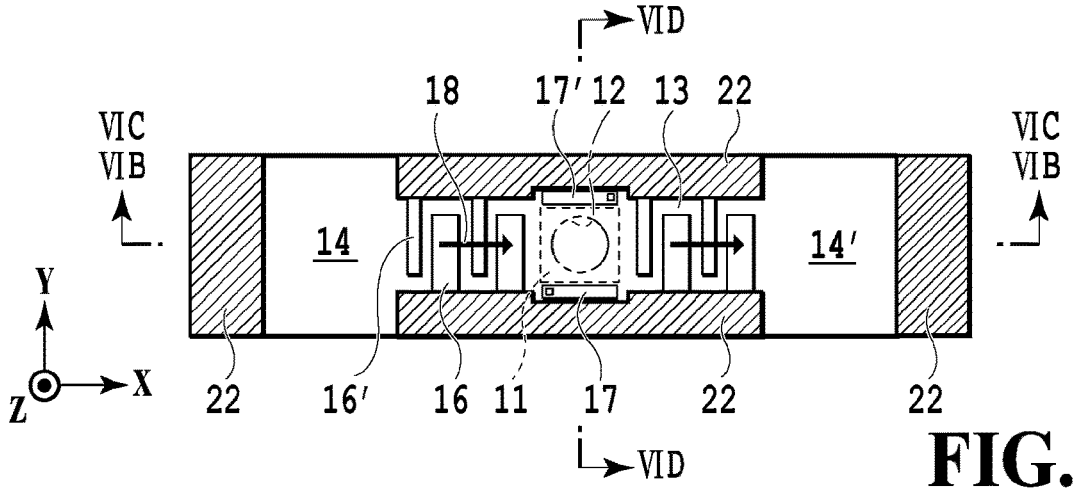
FIG. 6A to FIG. 6D are each a schematic diagram of a liquid ejection head according to a second embodiment.
Figure 6B:
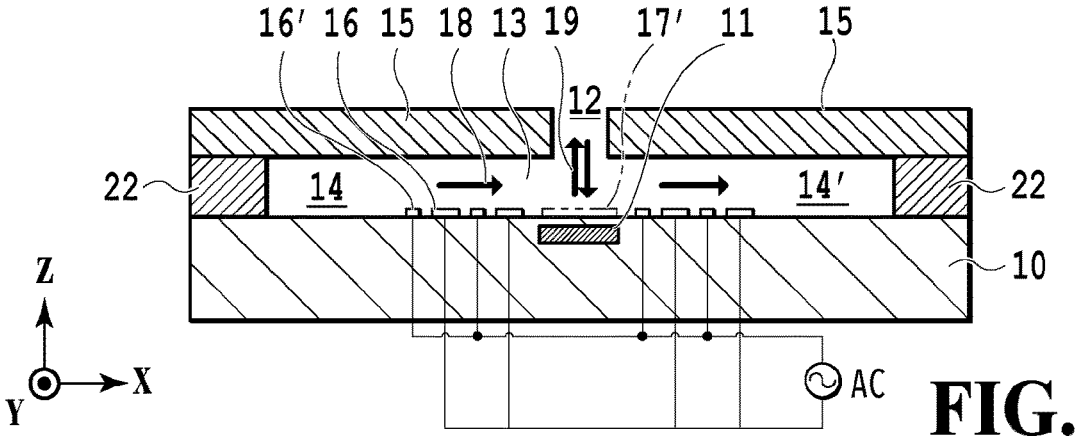
Figure 6C:
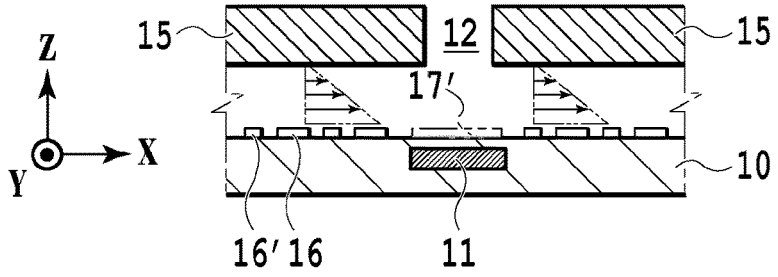
Figure 6D:
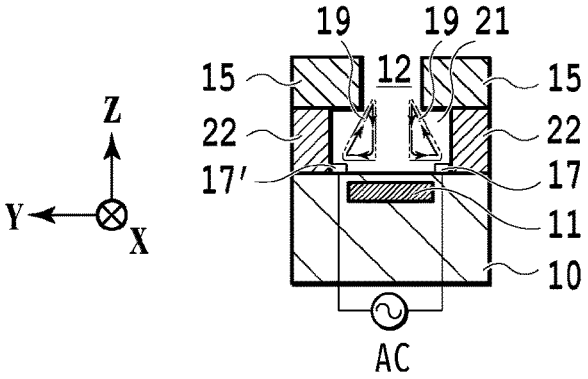

FIG. 6A is a schematic diagram showing the structure of the printing element substrate 1 of the liquid ejection head according to the second embodiment of the present invention and specifically, FIG. 6A a diagram showing a plane obtained by truncating the printing element substrate 1 in a plane parallel to the bonding face of the support substrate 10 and the ejection port forming member 15. FIG. 6B is a schematic diagram showing a liquid movement direction on a section along a VIB-VIB line in FIG. 6A. FIG. 6C is a schematic diagram showing a flow velocity distribution on a section shown in FIG. 6B. FIG. 6D is a schematic diagram showing a flow velocity distribution on a section along a VID-VID line in FIG. 6A. FIG. 6A shows only the one ejection port 12 and the liquid flow path 13 and the liquid supply flow paths 14 and 14' corresponding thereto, but the configuration of the ejection port row 20 and the liquid supply flow paths 14 and 14' is the same as that of the first embodiment.

In the present embodiment, the liquid flow path 13 is provided with the electrodes configuring the first circulating elements 16 and 16' and the liquid chamber 21 is provided with the electrodes configuring the second circulating elements 17 and 17'. Both the first circulating elements 16 and 16' and the second circulating elements 17 and 17' are provided on the support substrate 10. One element of the first circulating elements 16 and 16' is connected to one end (+ terminal) of the alternating-current power source AC and the other element is connected to the other end (– terminal) of the alternating-current power source AC.

As for the first circulating element 16, the dimension in the direction along the ink flow direction, that is, along the liquid flow path 13 is greater than the dimension of the first circulating element 16' and on the other hand, the dimension of the first circulating element 16 in the direction perpendicular to the ink flow direction is about the same as the dimension of the first circulating element 16'. Consequently, the surface area of the first circulating element 16, with which ink comes into contact, is larger than the surface area of the first circulating element 16', with which ink comes into contact.

A plurality of pairs of the first circulating elements 16 and 16' is provided in the liquid flow path 13 and the first circulating element 16 and the first circulating element 16' are provided alternately. In the liquid flow path 13 in which the circulatory flow is formed, it is sufficient to provide at least one pair of the first circulating elements 16 and 16' adjacent to each other. In the configuration illustrated in FIG. 6A to FIG. 6D, the four pairs of the first circulating elements 16 and 16' are arranged in the liquid flow path 13.

The first circulating element 16 or each of a plurality of the first circulating elements 16 is connected to a first common wire and the first circulating element 16' or each of a plurality of the first circulating elements 16' is connected to a second common wire (not shown schematically). The pair of the second circulating elements 17 and 17' provided within the liquid chamber 21 is the same as that of the first embodiment.

To the electrode configuring the first circulating elements 16 and 16', an alternating-current voltage is applied. As a result of that, as indicated by an arrow in FIG. 6C, a flow velocity distribution occurs within the liquid flow path 13, in which the flow velocity at the surface of the support substrate 10 is high and the flow velocity gradually approaches zero as the ejection port forming member 15 becomes nearer. Consequently, in each pair of the first circulating elements 16 and 16', a steady flow occurs that advances from the first circulating element 16' whose dimension in the flow path direction is small toward the first circulating element 16 whose dimension in the flow path direction is great.

To the electrode configuring the second circulating elements 17 and 17', an alternating-current voltage is applied. As a result of that, as shown in FIG. 6D, a flow velocity distribution occurs within the liquid chamber 21, in which the flow velocity at the surface of the support substrate 10 is high and the flow velocity gradually approaches zero as the ejection port forming member 15 becomes nearer, resulting in formation of the liquid chamber circulatory flow 19.

Figure 4B:
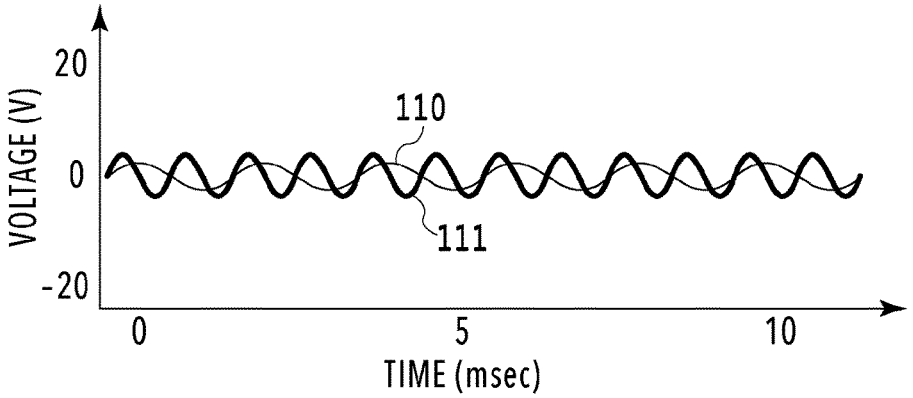

FIG. 4B is an image diagram of the drive signal of each circulating element in a case where both the first circulating elements 16 and 16' and the second circulating elements 17 and 17' according to the present embodiment are driving. In FIG. 4B, symbol 110 indicates the sinusoidal wave as the drive signal of the first circulating elements 16 and 16'. The first circulating elements 16 and 16' are AC electroosmotic flow generating elements and in order to drive the first circulating elements 16 and 16', a sinusoidal wave alternating-current voltage that varies in a range of ±2.5 V is applied at 500 Hz.

Further, in FIG. 4B, symbol 111 indicates the sinusoidal wave as the drive signal of the second circulating elements 17 and 17'. The second circulating elements 17 and 17' are AC electroosmotic flow generating elements and in order to drive the second circulating elements 17 and 17', a sinusoidal wave alternating-current voltage that varies in a range of ±3.0 V is applied at 1 kHz. The respective signal waveforms as the drive signals of the first circulating elements 16 and 16' and the second circulating elements 17 and 17' according to the present embodiment are not limited to those described previously. It is possible to selectively set the voltage, the frequency, and the drive waveform in a range in which desired flow velocity is obtained for the liquid flow path circulatory flow 18 and the liquid chamber circulatory flow 19 described previously.

Figure 5B:
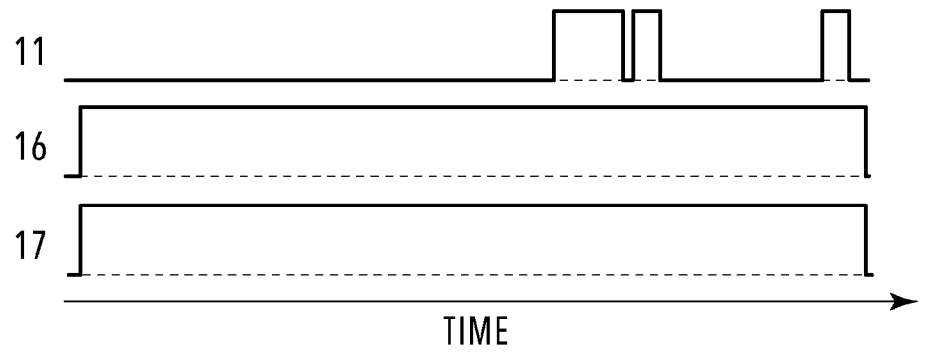

As shown in FIG. 5B, the driving timing of the first circulating elements 16 and 16' and the second circulating elements 17 and 17' is not interlocked with the driving timing of the energy generating element 11. In the ejection standby state, by both the first circulating element 16 and the second circulating elements 17 and 17' driving at all times, the liquid flow path circulatory flow 18 and the liquid chamber circulatory flow 19 are formed.

About Effect of the Present Embodiment

By the above configuration, an ink flow that advances from one end toward the other within the liquid flow path 13 occurs by the first circulating elements 16 and 16' and a fresh ink flow that crosses the liquid chamber 21 occurs. Further, by the second circulating elements 17 and 17', an ink flow component that advances toward the ejection port 12 within the liquid chamber 21 occurs. By the configuration such as this, which combines the first circulating element and the second circulating element, by pushing out the thickened ink within the ejection port 12 into the liquid chamber 21 and sending fresh ink into the liquid chamber 21, it is made possible to efficiently discharge the concentrated ink to the outside of the liquid chamber 21. Consequently, according to the present embodiment, it is possible to eject comparatively fresh ink whose effect of mitigating ink thickening within the ejection port 12 is significant and whose degree of thickening is low. Further, in the present embodiment, by adopting the configuration that does not use a heating element for formation of the liquid flow path circulatory flow 18, it is made possible to suppress a rise in temperature of the liquid ejection head to a degree lower than that in the first embodiment. As a result, it is made possible to reduce image color unevenness.

Third Embodiment

In the following, a printing element substrate of a liquid ejection head according to a third embodiment of the present invention is explained. In the following explanation, differences from the first embodiment are explained mainly. The contents of the portion whose specific explanation is omitted are the same as those of the first embodiment.

Figure 7A:
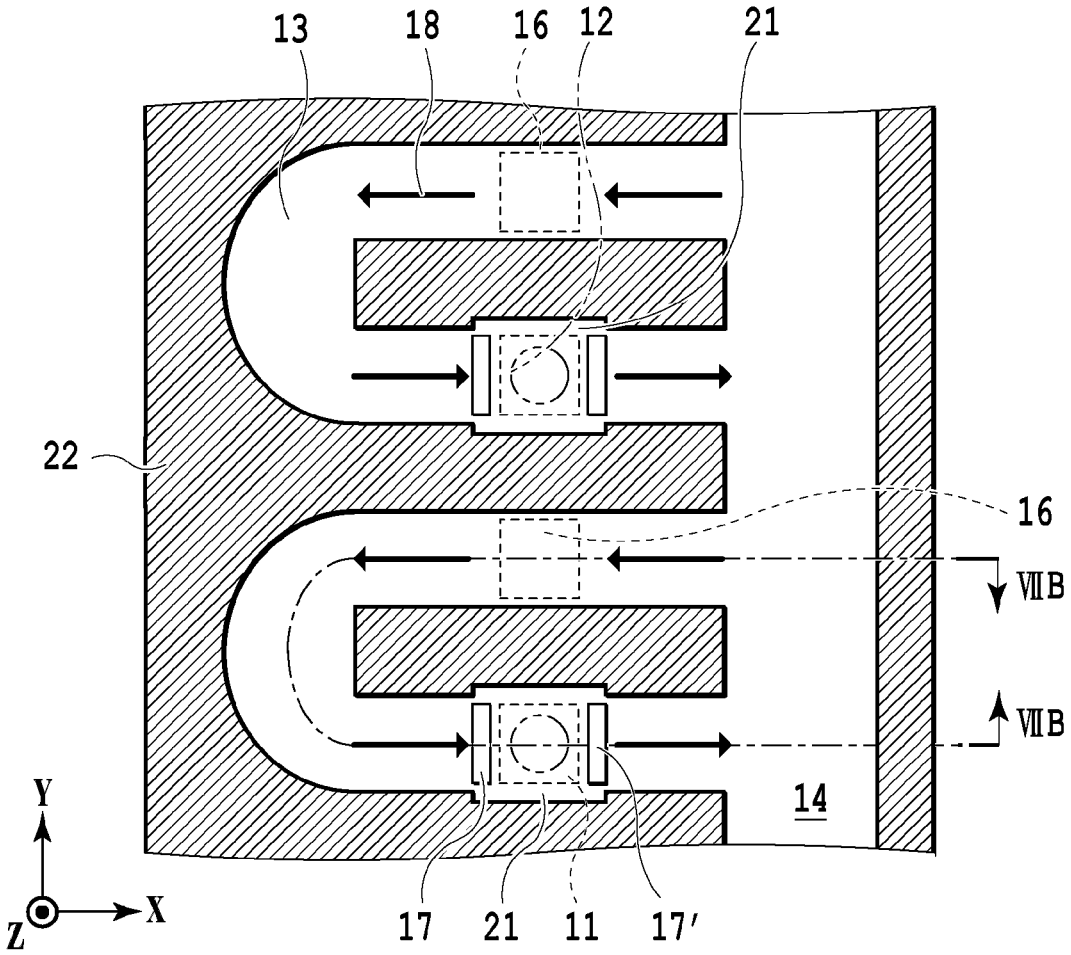
FIG. 7A and FIG. 7B are each a schematic diagram of a liquid ejection head according to a third embodiment.
Figure 7B:
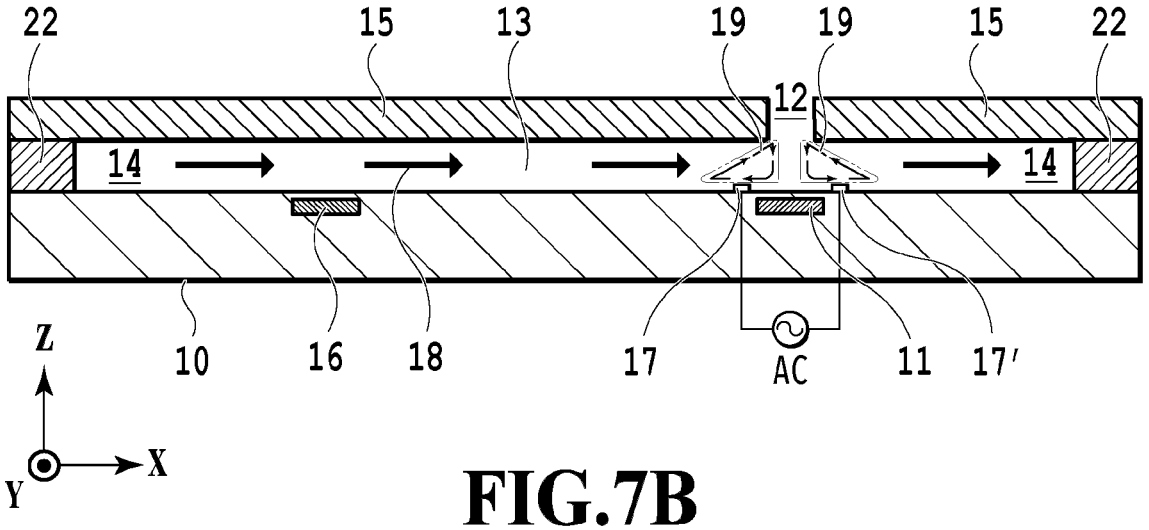

FIG. 7A is a schematic diagram showing the structure of the printing element substrate 1 of the liquid ejection head according to the third embodiment of the present invention. Specifically, FIG. 7A is a diagram showing a plane obtained by truncating the printing element substrate 1 in a plane parallel to the bonding face of the support substrate 10 and the ejection port forming member 15. FIG. 7B is a schematic diagram showing a liquid movement direction and a flow velocity distribution on a section along a VIIB-VIIB line in FIG. 7A.

As shown in FIG. 7A, in the present embodiment, the liquid flow path 13 for each ejection port 12 changes its direction by 180° on the way and is connected to the same liquid supply flow path 14 at both ends of the flow path. That is, the configuration is such that the ink supplied from the liquid supply flow path 14 returns to the liquid supply flow path 14 again via the liquid flow path 13 and the liquid chamber 21. In a case where the configuration such as this is adopted, it is not necessary to arrange the two liquid supply flow paths for one ejection port, which is necessary in the first embodiment (see FIG. 1B). Consequently, in the present embodiment, it is easy to reduce the dimension in the width direction of the support substrate 10 compared to the first embodiment and it is possible to downsize the printing element substrate 1.

Figure 4C:
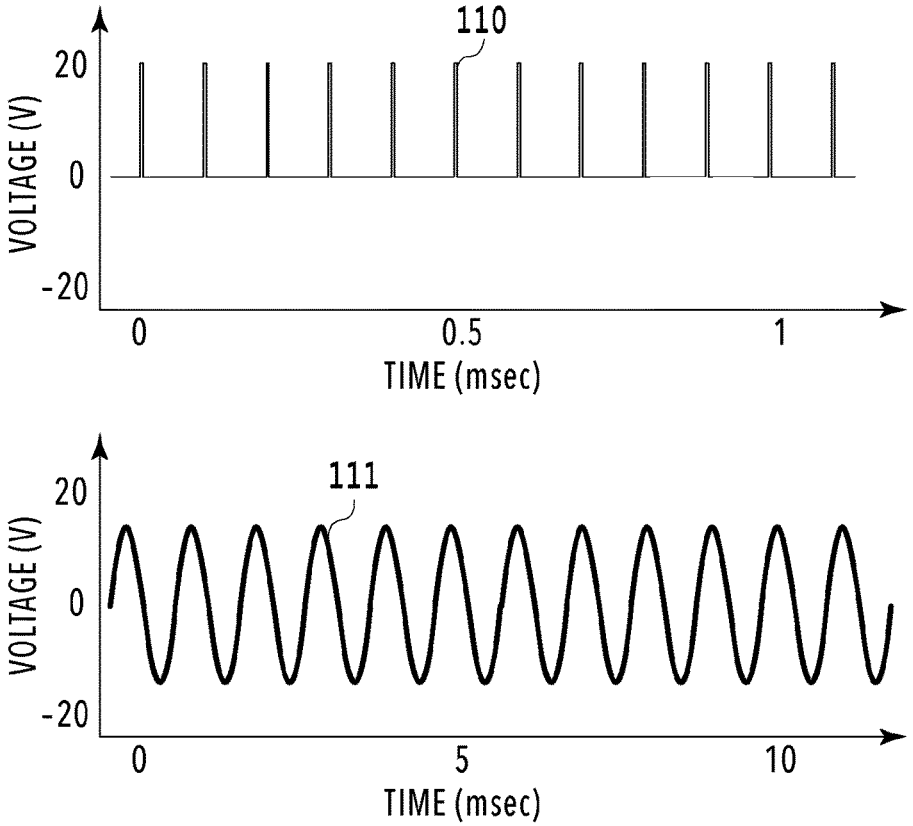

In the present embodiment, the first circulating element 16 is a heating element. Symbol 110 in FIG. 4C indicates a pulse wave as the drive signal of the first circulating element 16. As shown in FIG. 4C, in order to drive the first circulating element 16, a voltage of 24 V is applied at 1 kHz. As a result of that, the liquid flow path circulatory flow 18 that advances from one end toward the other end of the liquid flow path 13 occurs as shown in FIG. 7A and FIG. 7B.

The second circulating elements 17 and 17' are configured by two electrodes. In the present embodiment, as shown in FIG. 7A, the second circulating elements 17 and 17' are arranged on both sides of the energy generating element 11 within the liquid chamber 21 so that the second circulating elements 17 and 17' are arranged side by side in the flow direction of the liquid flow path 13. The arrangement position of the second circulating element is not limited to this and it is possible to arrange the second circulating element at an arbitrary position within the liquid chamber 21.

Figure 8A:
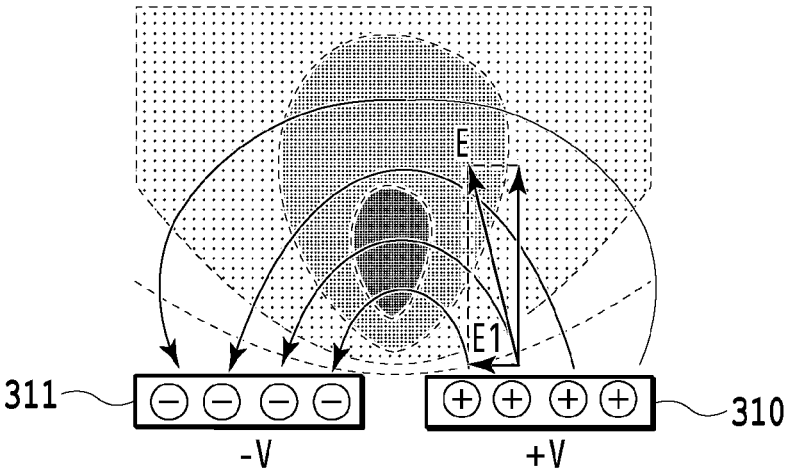
FIG. 8A to FIG. 8C are each a schematic diagram for explaining a mechanism of occurrence of a flow velocity distribution that occurs by an AC electrothermal flow.
Figure 8B:
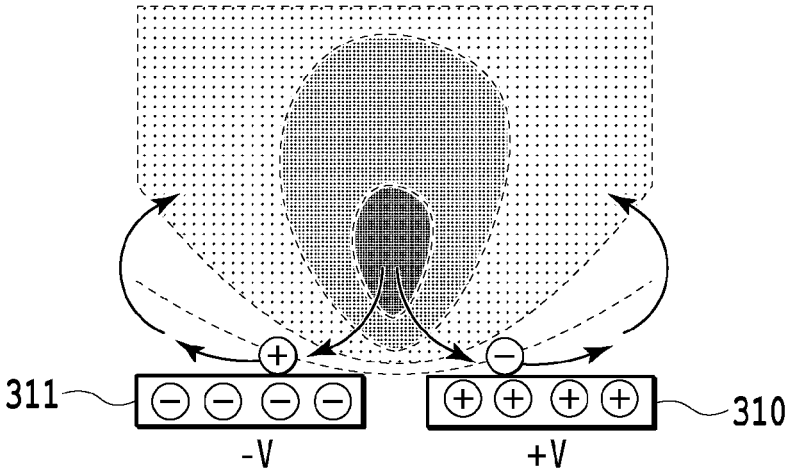

As shown in FIG. 4C, in order to drive the second circulating elements 17 and 17', a sinusoidal wave alternating-current voltage that varies in a range of ±15 V is applied at 1 MHz. As a result of that, as shown in FIG. 7B, a flow velocity distribution occurs within the liquid chamber 21, in which the flow velocity is high at the surface of the support substrate 10 and the flow velocity approaches zero as the ejection port forming member 15 becomes nearer, resulting in formation of the liquid chamber circulatory flow 19. The reason this flow velocity distribution occurs is explained by using FIG. 8A to FIG. 8C.

The two electrodes configuring the second circulating elements 17 and 17' are taken to be the first electrode 310 and the second electrode 311. The first electrode 310 and the second electrode 311 have the same dimension. In the present embodiment, the frequency of the drive signal to be applied to these electrodes is about 100 kHz to 100 MHz and a high-frequency alternating-current voltage is applied. In a case where an alternating-current voltage is applied between thin film electrodes, a temperature distribution as shown in 8A is formed in the solution due to the Joule heat. Charges induced by the electric field that is applied migrate and a flow as indicated by an arrow in FIG. 8B occurs. This flow is called an AC electrothermal flow (ACETF).

Figure 8C:
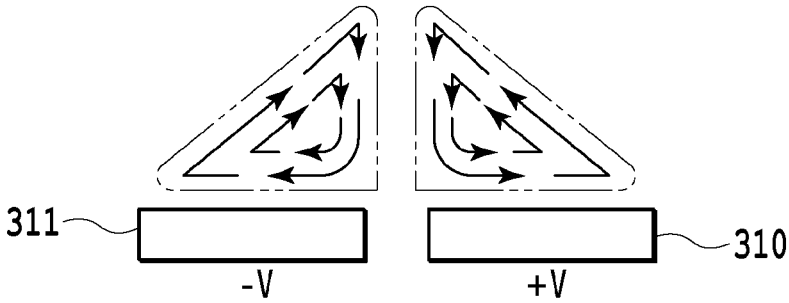

The AC electrothermal flow is a flow phenomenon that is elicited mainly under the conditions of a high frequency (specifically, 100 kHz or higher) and a high conductivity (specifically, 0.1 $Sm^{-1}$ or higher) and forms a circulatory flow as indicated by an arrow in FIG. 8C. While the electroosmotic flow is characterized by that a strong liquid flow is obtained by ink whose electric conductivity is low, the AC electrothermal flow is characterized by that a strong liquid flow is obtained by ink whose electric conductivity is high. Further, the specifications of the power source necessary at the time of drive are also different, and therefore, it is possible to arbitrarily select elements used for the first circulating element 16 and the second circulating element 17 in accordance with the circulation flow velocity, the ink type, the configuration of the printing element, and the like.

By the electrothermal current such as this, which is a steady flow, a flow velocity distribution occurs (see FIG. 7B), which forms two vortexes at positions substantially symmetrical with respect to the energy generating element 11 or the ejection port 12 as a reference. A flow component that passes the vicinity of the ejection port 12 is formed. and therefore, it is possible to cause the ink concentrated in the vicinity of the ejection port 12 to flow. Consequently, it is easy to suppress ink concentration in the vicinity of the ejection port 12. The second circulating elements 17 and 17' are connected to the alternating-current power source AC and a drive voltage whose frequency is high compared to that of the first embodiment is applied, and therefore, the occurrence of bubbles by water electrolysis is suppressed and it is made possible to make the drive voltage higher than that in the first embodiment.

Figure 5C:
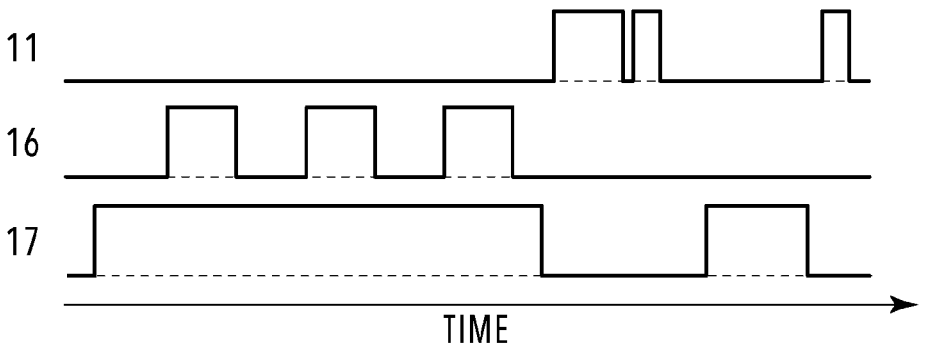

As shown in FIG. 5C, the driving timing of the first circulating element 16 and the second circulating elements 17 and 17' is interlocked respectively with the driving timing of the energy generating element 11. Specifically, the first circulating element 16 drives by avoiding the period during which the energy generating element 11 is driving and a predetermined period before and after the drive thereof so that the first circulating element 16 is not affected by bubble generation by the energy generating element 11, which is a heating element, and the pressure variation by ink refill, and thus, the liquid flow path circulatory flow 18 is formed. Then, in order to reduce the influence of heating due to bubble generation, drive and non-drive are repeated periodically. Further, in order to suppress the influence on ejection due to the circulatory flow within the liquid chamber 21, the second circulating elements 17 and 17' also drive by avoiding the period during which the energy generating element 11 is driving and a predetermined period before and after the drive thereof. It is preferable for the driving frequency (number of driving times per unit time) of the first circulating element to be lower than the driving frequency of the second circulating frequency. However, the drive conditions of the present embodiment are merely exemplary and the voltage, the frequency, the waveform of the drive signal, and the driving timing are not limited.

About Effect of the Present Embodiment>

In the present embodiment, also in a case where ink is not being ejected, a flow is formed in which the ink having flowed into the liquid flow path 13 from the liquid supply flow path 14 returns again to the liquid supply flow path 14. Further, it is possible to drive the second circulating elements 17 and 17' under the condition of a voltage higher than that of the first embodiment, and therefore, it is made possible to form a within-liquid chamber circulatory flow stronger than that of the first embodiment. Because of this, like the first embodiment, the effect of suppressing stagnation of concentrated ink within the liquid chamber 21 is obtained.

Fourth Embodiment

In the following, a printing element substrate of a liquid ejection head according to a fourth embodiment of the present invention is explained. In the following explanation, differences from the first embodiment are explained mainly. The contents of the portion whose specific explanation is omitted are the same as those of the first embodiment.

Figure 9A:
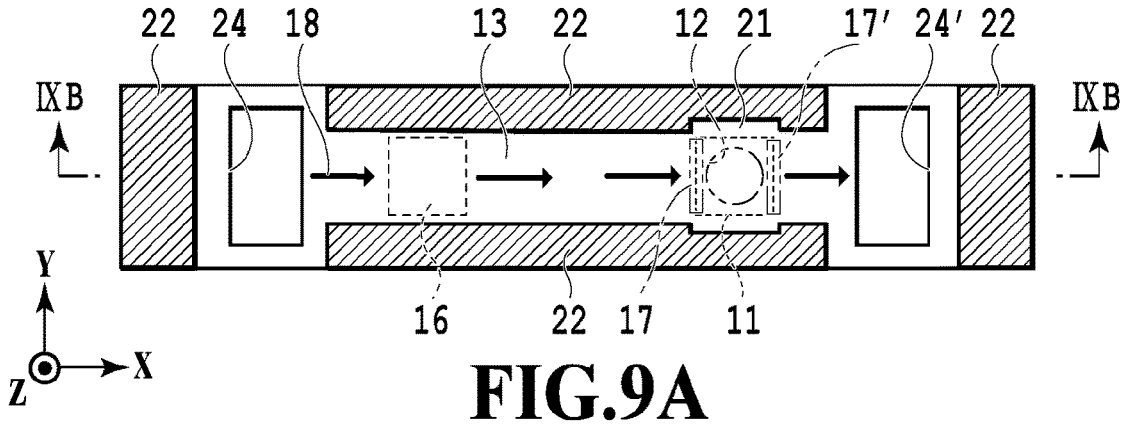
FIG. 9A to FIG. 9C are each a schematic diagram of a liquid ejection head according to a fourth embodiment.
Figure 9B:
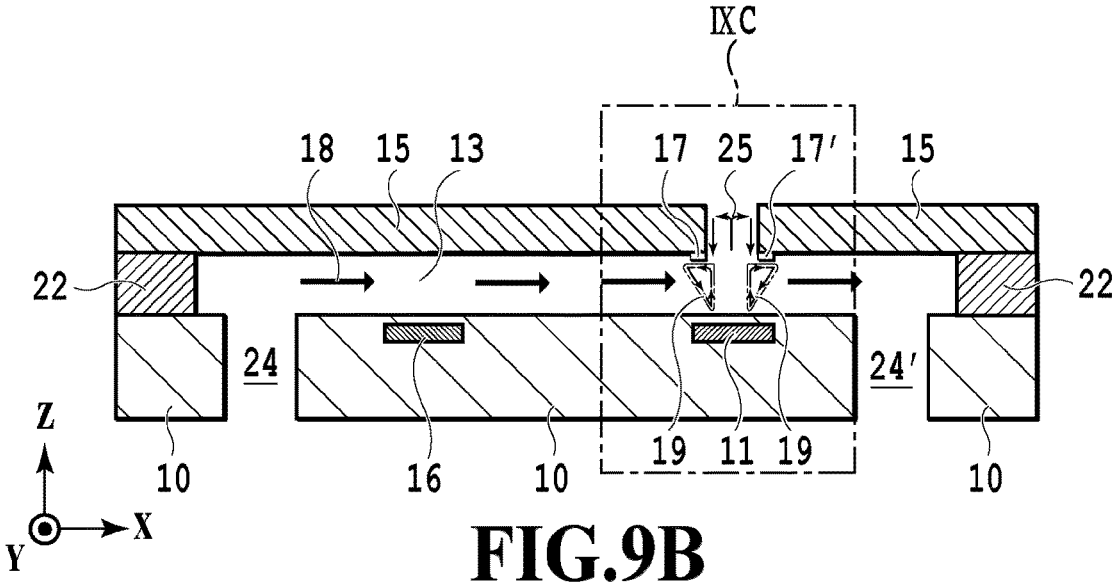
Figure 9C:
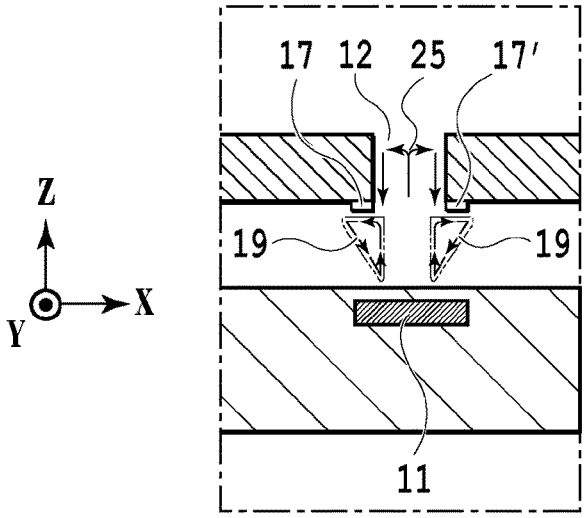

FIG. 9A is a schematic diagram showing the structure of the printing element substrate 1 of the liquid ejection head according to the fourth embodiment of the present invention and specifically, FIG. 9A is a diagram showing a plane obtained by truncating the printing element substrate 1 in a plane parallel to the bonding face of the support substrate 10 and the ejection port forming member 15. FIG. 9B is a schematic diagram showing a liquid movement direction and a flow velocity distribution on a section along an IXB-IXB line in FIG. 9A. FIG. 9C is an enlarged diagram of a one-dot chain line area IXC in FIG. 9B.

In the support substrate 10, a plurality of through holes 24 and a plurality of through holes 24' are formed, both penetrating from the surface of the support substrate 10 to the backside. As shown in FIG. 9A, the liquid chamber 21 and the through holes 24 and 24' are provided for each corresponding ejection port 12. With the ejection port row configured by a plurality of the ejection ports 12 being sandwiched in between, a first through hole row configured by the plurality of the through holes 24 and a second through hole row configured by the plurality of the through holes 24' extend in parallel. Although not shown in FIG. 9B, on the lower side of the support substrate 10, a liquid supply flow path that communicates with both the through holes 24 and the through holes 24' is provided in FIG. 9B and this liquid supply flow path is shared by the through holes 24 and the through holes 24'.

In the present embodiment, the first circulating element 16 is a heating element and formed in the support substrate 10. Further, the second circulating elements 17 and 17' are electrothermal flow elements and formed on the surface on the side of the liquid flow path 13 of the ejection port forming member 15. By the configuration of the present embodiment, as shown in FIG. 9B, it is possible to arrange the second circulating elements 17 and 17' in the vicinity of the ejection port 12 (in the vertical direction in FIG. 9B) compared to the embodiments described previously. Further, as shown in FIG. 9A, it is made possible to arrange the second circulating elements 17 and 17' so as to overlap the energy generating element 11 within the plane of the support substrate 10. Consequently, it is also made possible to arrange the second circulating elements 17 and 17' in the closer vicinity of the ejection port 12 (in the horizontal direction in FIG. 9A) compared to the embodiments described previously. Consequently, in the vicinity of the ejection port 12, it is possible to form the liquid chamber circulatory flow 19 as a strong vortex flow that advances from the ejection port forming member 15 toward the support substrate 10. Accompanying the formation of the vortex flow, an involving flow 25 occurs, and therefore, it is possible to replace the ink within the ejection port 12 more efficiently.

About Effect of the Present Embodiment

In the present embodiment, also in a case where ink is not being ejected, a flow is formed in which the ink having flowed into the liquid flow path 13 from the through hole 24 flows to the outside of the liquid flow path 13 from the through hole 24'. Further, by the second circulating elements 17 and 17' arranged in the vicinity of the ejection port 12, it is made possible to form the liquid chamber circulatory flow 19 more effective than that of the embodiments described previously (see FIG. 1D and the like), and therefore, it is possible to efficiently replace the concentrated ink within the ejection port 12. Because of this, like the first embodiment, the effect of suppressing stagnation of concentrated ink within the liquid chamber 21 is obtained.

Fifth Embodiment

In the following, a printing element substrate of a liquid ejection head according to a fifth embodiment of the present invention is explained. In the following explanation, differences from the first embodiment are explained mainly. The contents of the portion whose specific explanation is omitted are the same as those of the first embodiment.

Figure 10A:
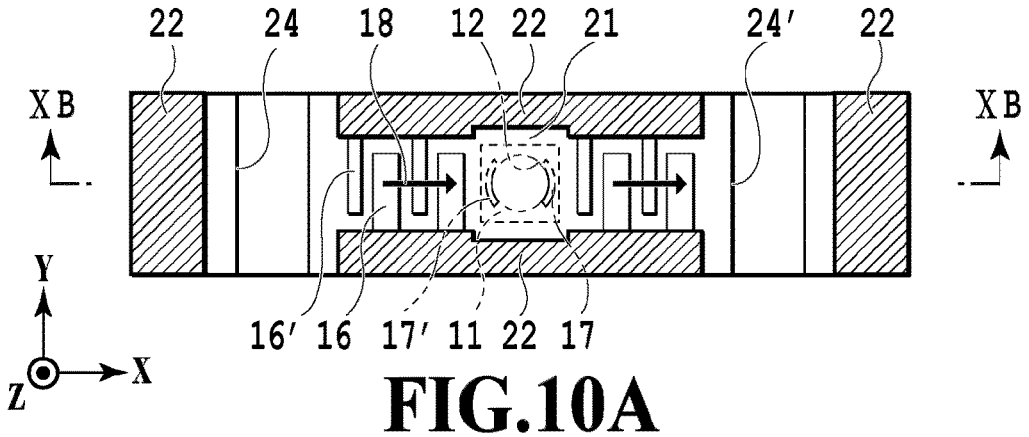
FIG. 10A to FIG. 10C are each a schematic diagram of a liquid ejection head according to a fifth embodiment.
Figure 10B:
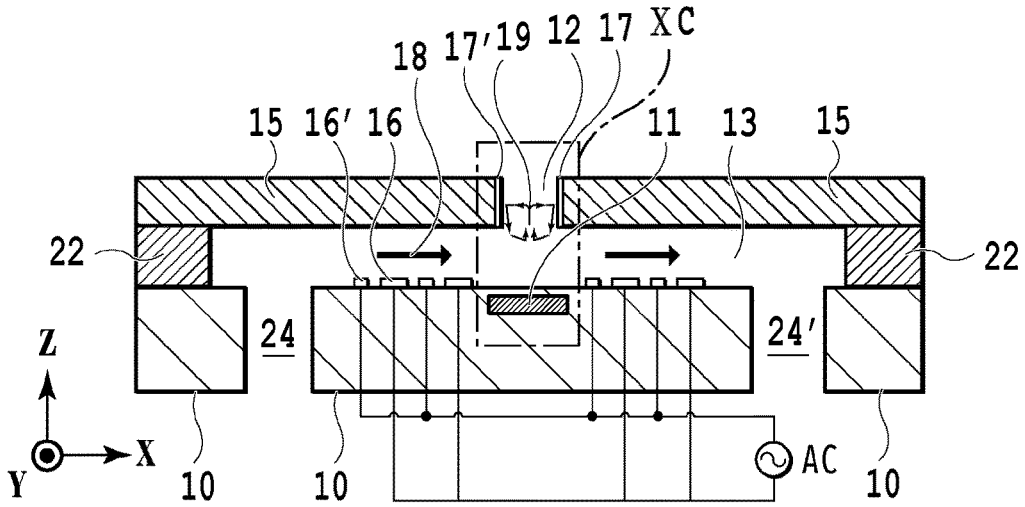
Figure 10C:
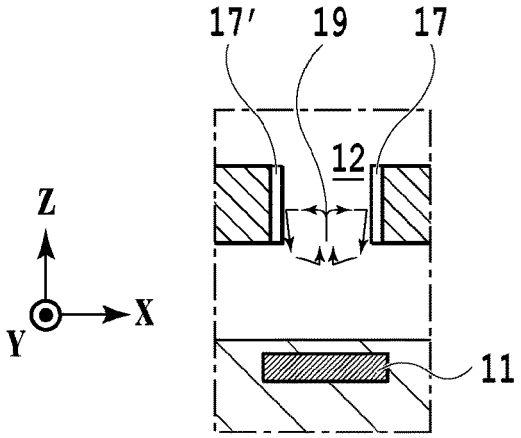

FIG. 10A is a schematic diagram showing the structure of the printing element substrate 1 of the liquid ejection head according to the fifth embodiment of the present invention and specifically, FIG. 10A is a diagram showing a plane obtained by truncating the printing element substrate 1 in a plane parallel to the bonding face of the support substrate 10 and the ejection port forming member 15. FIG. 10B is a schematic diagram showing a liquid movement direction and a flow velocity distribution on a section along an XB-XB line in FIG. 10A. FIG. 10C is an enlarged diagram of a one-dot chain line area XC in FIG. 10B.

In the fourth embodiment described previously, the through holes 24 and 24' for each ejection port 12 are provided (see FIG. 9A). In contrast to this, in the present embodiment as shown in FIG. 10A, a pair of the through holes 24 and 24' is shared by a plurality of the (for example, three) ejection ports 12. With an ejection port row configured by a plurality of the ejection ports 12 being sandwiched in between, a first through hole row configured by a plurality of the through holes 24 and a second through hole row configured by a plurality of the through holes 24' extend in parallel, and this is the same as in the fourth embodiment.

By adopting the configuration such as this, it is possible to substantially increase the dimension of the through holes 24 and 24' in the direction parallel to the extension direction of the ejection port row 20 compared to the fourth embodiment. Consequently, it is possible to reduce the dimension of the through holes 24 and 24' in the direction perpendicular to the extension direction of the ejection port row 20 by an amount corresponding thereto compared to the fourth embodiment. Because of this, compared to the third embodiment, it is easy to reduce the dimension in the width direction of the printing element substrate 1, and therefore, it is possible to downsize the printing element substrate 1. It may also be possible to provide one of the two through holes for each liquid flow path 13 as in the third embodiment.

In the present embodiment, the first circulating elements 16 and 16' are electrothermal flow elements in which an asymmetrical electrode pair is arranged and formed on the support substrate 10 as shown in FIG. 10B. By making the first circulating elements 16 and 16' an electrode pair whose lengths in the flow path direction are asymmetrical, an electric field asymmetrical in the flow path direction is formed and a liquid flow that advances in one direction from the electrode whose electrode length is short toward the electrode whose electrode length is long occurs. Further, the second circulating elements 17 and 17' are electrothermal flow elements and formed on the sidewall surface on the side of the ejection port 12 in the ejection port forming member 15 as shown in FIG. 10C. By laying out the configuration such as this, it is possible to arrange the second circulating elements 17 and 17' inside the ejection port 12. Consequently, it is possible to form a flow distribution that replaces the ink within the ejection port 12 more efficiently than the embodiments described previously. Here, the case is described where as for the electrode pair of the second circulating elements 17 and 17', the entire electrodes are arranged inside the ejection port 12, but what is required is that at least a part of the electrode be arranged inside the ejection port 12.

About Effect of the Present Embodiment

In the present embodiment, also in a case where ink is not being ejected, a flow is formed in which the ink having flowed into the liquid flow path 13 from the through hole 24 flows out to the outside of the liquid flow path 13 from the through hole 24'. Further, by the second circulating elements 17 and 17' arranged within the ejection port 12, it is made possible to form the liquid chamber circulatory flow 19 more effective than that of the embodiments described previously (see FIG. 1D and the like), and therefore, it is possible to efficiently replace the concentrated ink within the ejection port. Because of this, like the first embodiment, the effect of suppressing stagnation of concentrated ink within the liquid chamber 21 is obtained.

Sixth Embodiment

Figure 11A:
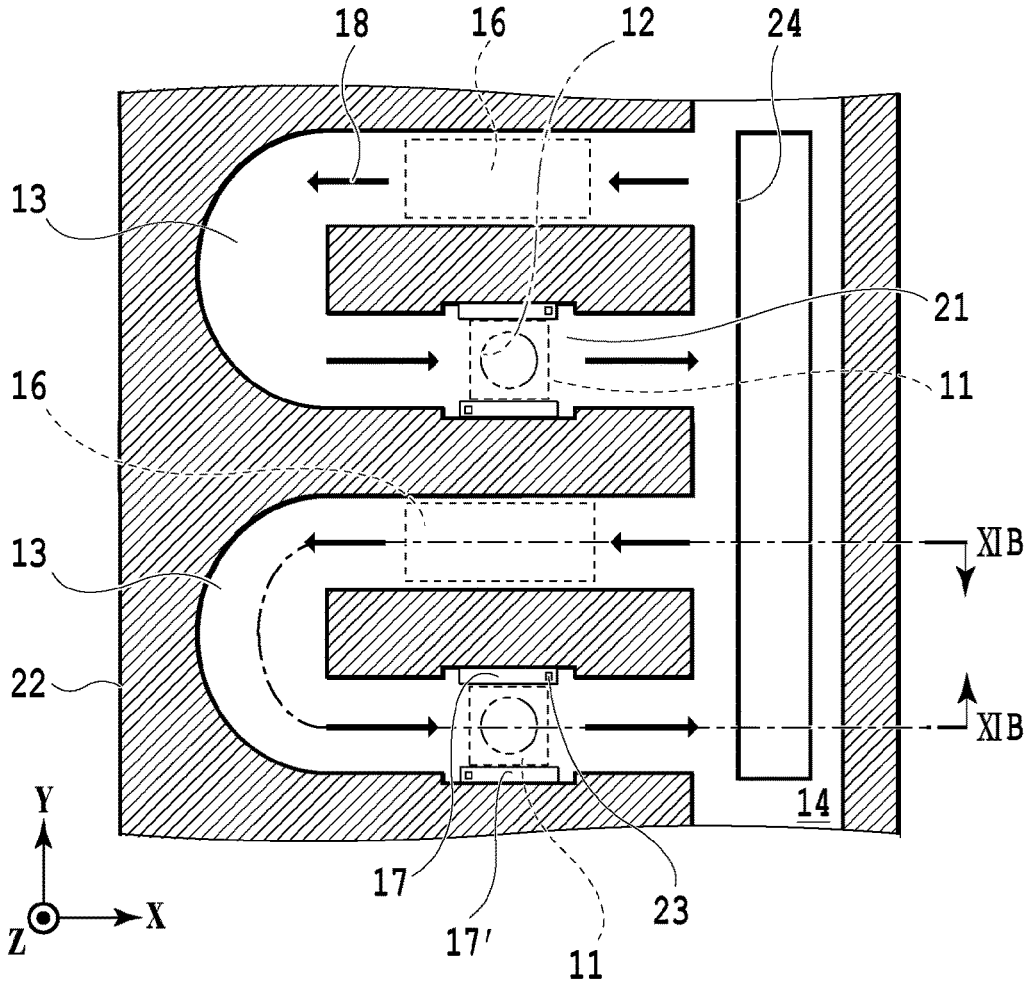
FIG. 11A and FIG. 11B are each a schematic diagram of a liquid ejection head according to a sixth embodiment.
Figure 11B:
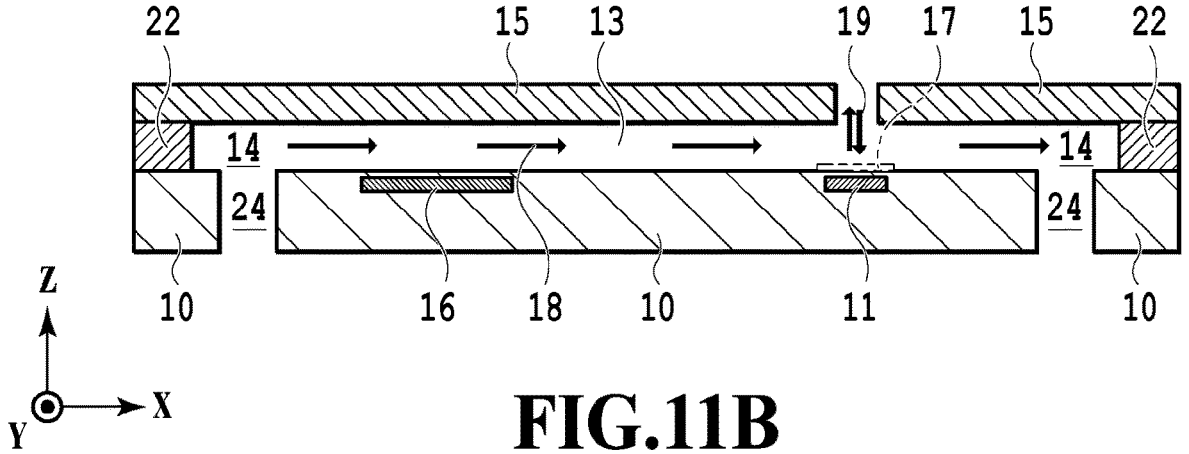

By using FIG. 11A and FIG. 11B, the configuration of a printing element substrate of a liquid ejection head according to a sixth embodiment of the present invention is explained. In the following explanation, differences from the first embodiment are explained mainly, and therefore, the contents of the portion whose specific explanation is omitted are the same as those of the first embodiment.

FIG. 11A and FIG. 11B are each a schematic diagram showing the structure of the printing element substrate 1 of the liquid ejection head according to the sixth embodiment of the present invention and specifically, FIG. 11A is a diagram showing a plane obtained by truncating the printing element substrate 1 in a plane parallel to the bonding face of the support substrate 10 and the ejection port forming member 15. FIG. 11B is a schematic diagram showing a liquid movement direction on a section along an XIB-XIB line in FIG. 11A.

As shown in FIG. 11A, in the present embodiment, the liquid flow path 13 for each ejection port 12 changes its direction by 180° on the way and is connected to the same liquid supply flow path 14 at both ends of the flow path. In the liquid supply flow path 14, the through hole 24 extending across a plurality of the liquid flow paths 13 is formed. As described above, the through hole 24 has a great width in the extension direction compared to the direction perpendicular to the extension direction of the ejection port row 20.

In the present embodiment, the first circulating element 16 is a heating element arranged in the support substrate 10. Compared to the third embodiment (see FIG. 7A) in which the size of the first circulating element 16 and the size of the energy generating element 11 are substantially the same, the area of the portion of the first circulating element 16 according to the present embodiment, which comes into contact with ink, is large, and therefore, it is possible to cause the liquid flow path circulatory flow 18 to occur more strongly. The second circulating elements 17 and 17' are electroosmotic flow elements and formed on the support substrate 10 and within the liquid chamber 21 in a form sandwiching the energy generating element 11 in between.

About Effect of the Present Embodiment

In the present embodiment, by adopting the first circulating element 16 larger than that of the embodiments described previously, also in a case where ink is not being ejected, a flow is formed more strongly in which the ink having flowed into the liquid flow path 13 from the through hole 24 flows out to the outside of the liquid flow path 13 from the through hole 24. Further, by the second circulating elements 17 and 17' arranged within the liquid chamber 21, it is possible to replace concentrated ink within the ejection port 12. Because of this, like the first embodiment, the effect of suppressing stagnation of concentrated ink within the ejection port 12 and within the liquid chamber 21 is obtained.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present invention, thickening of a liquid due to evaporation from an ejection port is mitigated and it is made possible to stably eject the liquid from the ejection port.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-241290, filed Dec. 25, 2018, which is hereby incorporated by reference herein in its entirety.

What is claimed is:

1. A liquid ejection head comprising:

a support substrate;

a liquid chamber arranged on the support substrate and provided with an energy generating element for generating energy necessary for ejection of a liquid and an ejection port from which the liquid is ejected;

a circulation flow path of the liquid that passes through the liquid chamber;

a first circulating element that forms a first circulatory flow in the circulation flow path; and a second circulating element that forms a second circulatory flow inside the liquid chamber, wherein a driving frequency of the first circulating element is lower than a driving frequency of the second circulating element.

2. The liquid ejection head according to claim 1, wherein the first circulating element is arranged outside the liquid chamber, and the second circulating element is arranged inside the liquid chamber.

3. The liquid ejection head according to claim 1, wherein the first circulatory flow is a flow that collects the liquid not ejected from the ejection port from the liquid chamber as well as guides the liquid to the liquid chamber, and the second circulatory flow is a flow that circulates inside the liquid chamber.

4. The liquid ejection head according to claim 1, wherein the second circulatory flow includes a flow component that advances from the inside of the liquid chamber toward the ejection port.

5. The liquid ejection head according to claim 1, wherein the first circulating element is a heating element or an electrode pair, and the second circulating element is an electrode pair.

6. The liquid ejection head according to claim 5, wherein the first circulating element is a heating element, and a size of the heating element is larger than a size of the energy generating element.

7. The liquid ejection head according to claim 5, wherein in a case where the first circulating element is an electrode pair, the first circulatory flow is an AC electroosmotic flow or an AC electrothermal flow and the second circulatory flow is an AC electroosmotic flow or an AC electrothermal flow.

8. The liquid ejection head according to claim 7, wherein a first electrode and a second electrode configuring the electrode pair of the second circulating element are arranged so as to be symmetrical with respect to the ejection port as a reference.

9. The liquid ejection head according to claim 8, wherein a rotation direction of a first vortex flow formed in the vicinity of the first electrode is opposite to a rotation direction of a second vortex flow formed in the vicinity of the second electrode.

10. The liquid ejection head according to claim 1, wherein at least one of the first circulating element and the second circulating element is driven by interlocking with timing at which the energy generating element is driven.

11. The liquid ejection head according to claim 10, wherein at least one of the first circulating element and the second circulating element is driven by avoiding a period during which the energy generating element is driven and a predetermined period before and after being driven.

12. The liquid ejection head according to claim 1, wherein both the first circulating element and the second circulating element are provided on the support substrate.

13. The liquid ejection head according to claim 1, wherein the ejection port is formed in a member that the support substrate supports, and the first circulating element and the second circulating element are provided at positions different in height in a direction perpendicular to a bonding face of the support substrate and the member.

14. The liquid ejection head according to claim 13, wherein the first circulating element is provided in the support substrate, and the second circulating element is provided in the member.

15. The liquid ejection head according to claim 14, wherein at least a part of the second circulating element is arranged inside the ejection port.

16. The liquid ejection head according to claim 1, wherein each of an end portion on an upstream side in the circulation flow path and an end portion on a downstream side in the circulation flow path communicates with an identical flow path.

17. A control method of a liquid ejection head having:

a support substrate;

a liquid chamber arranged on the support substrate and provided with an energy generating element for generating energy necessary for ejection of a liquid and an ejection port from which the liquid is ejected; and a circulation flow path of the liquid that passes through the liquid chamber, the control method comprising:

a first step of forming a first circulatory flow in the circulation flow path by a first circulating element; and a second step of forming a second circulatory flow inside the liquid chamber by a second circulating element, wherein a driving frequency of the first circulating element is lower than a driving frequency of the second circulating element.

18. The control method according to claim 17, wherein the first step and the second step are performed at identical timing.

* * * * *